US006539928B2

(12) United States Patent
Kohno et al.

(10) Patent No.: US 6,539,928 B2
(45) Date of Patent: Apr. 1, 2003

(54) VEHICLE-MOUNTED IGNITOR

(75) Inventors: Yasuhiko Kohno, Naka (JP); Junpei Uruno, Hitachi (JP); Mutsuhiro Mori, Mito (JP)

(73) Assignee: Hitachi, Ltd., Tokyo (JP)

( * ) Notice: Subject to any disclaimer, the term of this patent is extended or adjusted under 35 U.S.C. 154(b) by 84 days.

(21) Appl. No.: 09/790,544

(22) Filed: Feb. 23, 2001

(65) Prior Publication Data

US 2002/0040709 A1 Apr. 11, 2002

(30) Foreign Application Priority Data

Oct. 11, 2000 (JP) ..... 2000-310707

(51) Int. Cl.[7] ..... F02P 3/00
(52) U.S. Cl. ..... 123/605; 123/652
(58) Field of Search ..... 123/650, 652, 123/605

(56) References Cited

U.S. PATENT DOCUMENTS 5,058,560 A * 10/1991 Asakura et al. ..... 123/652
5,127,388 A * 7/1992 Cicalese et al. ..... 123/652
5,609,145 A * 3/1997 Kojima et al. ..... 123/652
6,257,216 B1 * 7/2001 Forster et al. ..... 123/652
2001/0037801 A1 * 11/2001 Ito et al. ..... 123/650
2002/0062825 A1 * 5/2002 Torres ..... 123/652

FOREIGN PATENT DOCUMENTS

JP 9-280147 10/1997

OTHER PUBLICATIONS

K. Yoshida et al., "*A Self-Isolated Intelligent IGBT for Driving Ignition Coils*", Proceedings of 1998 International Symposium on Power Semiconductor Devices & Ics, Kyoto, pp. 105–108.

* cited by examiner

*Primary Examiner*—Erick Solis
(74) *Attorney, Agent, or Firm*—Antonelli, Terry, Stout & Kraus, LLP

(57) ABSTRACT

A circuit for supplying an oscillation suppress current is provided between a collector terminal and gate electrode of a main IGBT. The current supply circuit comprises a resistor and a diode which are connected in series. A bypass MOSFET is connected between the series connection and the emitter terminal. No semiconductor element having different temperature characteristics is provided in the current supply circuit.

11 Claims, 14 Drawing Sheets

VEHICLE-MOUNTED IGNITOR

BACKGROUND OF THE INVENTION

The present invention relates to a vehicle-mounted ignitor in which an insulated gate type semiconductor device is used as a main switching element, and in particular to a vehicle-mounted ignitor, an insulated gate type semiconductor device and an engine system having a current restricting capability.

Enhancement in performance of the ignitors for engines has been strongly demanded for the energy-saving in vehicles. The ignitor is adapted to fire the fuel in the engine by generating a high voltage such as several tens thousand volts from a low voltage battery mounted on a vehicle depending upon the rotational number of the engine for discharging ignition plugs.

A vehicle-mounted ignitor in which an insulated gate type semiconductor device is used as a main switching element is disclosed in JP-A-09-280147.

It has been known that in the ignitor including a current restricting circuit for suppressing an overcurrent, an oscillation may occur when the current restricting current begins to operate, which causes various problems such as occurrence of noise and damages of devices. In order to prevent these problems from occurring, JP-A-09-280147 provides a current supply circuit which supplies a gate with a current from a collector for suppressing an abrupt increase in collector voltage at the beginning of the current restriction by supplying the gate with a current from a collector. A detailed example of the current supply circuit in which a high voltage constant current element which is combined with an IGBT and MOSFET is used is illustrated in FIGS. 1, 8 and 9 of JP-A-09-280147. The current flowing from the collector to the gate is restricted to a constant value by using the saturation characteristics of IGBT and MOSFET. Use of resistors and capacitors is illustrated in FIG. 7 of JP-A-09-280147.

The saturated current of the IGBT and MOSFET which are used to form the current supply circuit in JP-A-09-280147 largely varies with their temperatures. It tends to decrease as the temperature increases. There are certainly variations in saturation characteristics among IGBTs and MOSFETs. The variations in the characteristics of the current supply circuits cause the restricted current of the main insulated gate type semiconductor device (the invention will be described with reference to an IGBT) to vary so that the current capacity of the entire of the ignitor circuit should be designed to be larger. If it is assumed that the variation be 2 amperes in case in which the restricted current is 10 amperes, at least the allowable current capacity of the circuit should be designed to be 2 amperes or more. Accordingly, the capacity of the used circuit components (for example, capacitors, resisters) and the diameter of the cross-section of the wires becomes larger, which leads to an increase in the bulk and weight of the ignitor. This invites an increase in size of the engine and the fuel consumption. In order to increase the current capacity, it is necessary to increase the cross-section of the wire of the ignition coil, which increases the coil size. Since ignition coils are inserted into the engine body in a so-called distributorless ignition system in which one ignition coil is disposed for each cylinder of the engine, the increase in the size of the coils will invite an increase in size of the engine block. Further, holes of the engine block into which the coils are adapted will become larger in size so that the strength of the engine block will be lowered. As a result, the durability of the engine will be lowered.

Although the above-mentioned problem in which the characteristics vary will not occur in case in which the current supply circuit consists of resistors and capacitors, a problem will occur in that IGBT may malfunction. For example, when the IGBT is turned off to ignite the ignition coil, a high voltage which is about 400 V is applied across the collector and emitter of the IGBT in a usual ignitor. However, the gate voltage will increase due to a current flowing to the gate from the collector in the above-mentioned circuit. The IGBT is turned on again, for restricting the voltage across the collector and the emitter. This will suppress the inherent features of the ignitor. The voltage across the secondary coil of the ignition coil will decrease so that no arc is generated in the ignition plug. If the resistance is increased to prevent this, supply of the current to restrict the oscillation will become insufficient so that the oscillation suppression will be lowered.

SUMMARY OF THE INVENTION

It is an object of the present invention to provide a vehicle-mounted ignitor, insulated gate type semiconductor device and engine system having a current restricting capability which is compact in size and less in capacity, and causes no oscillation.

In an aspect of the present invention, an insulated gate type semiconductor device such as IGBT and power MOSFET is used as main switching element and an oscillation suppress current supply circuit potentially connects a main terminal of the main switching element having a higher potential to a control terminal of said switching element without interposing other semiconductor switching element in a vehicle-mounted ignitor including said oscillation suppress current supply circuit.

A phrase "potentially connected" used herein means "to provide a function to make both terminals equally potential by connecting via a resistor and a diode for supplying a current. For example, a capacitor does not have such function and is thus omitted. In a preferred embodiment, said current supply circuit comprises a resistor and a diode which are connected in series with each other and this circuit is connected between one of main terminals having higher potential and said control terminal.

This provides a vehicle-mounted ignitor having a capability of restricting a current and causing no oscillation without using any semiconductor switching element which is liable to have variations in temperature characteristics.

In another aspect of present invention, a vehicle-mounted ignitor including an oscillation suppress current supply circuit is characterized in that a circuit is provided which bypasses said current supply circuit to one of a pair of main terminals having a higher potential when a signal for driving the insulated gate type semiconductor element is not input to the control terminal. It is preferable to provide a bypass switching element which is connected between said current supply circuit and one of said pair of main terminals having a lower potential; and a circuit which turns on the switching element when a signal for driving the main semiconductor element is not input to the control terminal.

In the other aspect of the present invention, a vehicle-mounted ignitor including an oscillation suppress current supply circuit is characterized in that said current supply circuit is configured to supply the control terminal with current from one of the main terminals of the main insulated gate type semiconductor element, which is higher in potential, and to restrict said current to a predetermined value.

In a further aspect of the present invention, the vehicle-mounted ignitor including an oscillation suppress current supply circuit is characterized in that said current supply circuit supplies a current to said control terminal from said main terminal having a higher potential when said voltage of said main terminal having a higher potential is lower than a predetermined value and restricts the supply of the current to said control terminal when the voltage of said main terminal is higher than the predetermined value. In a preferred embodiment, said current supply circuit comprises a series circuit of two resistors which are connected in a direction toward said control electrode from said main terminal having a higher potential; and a constant voltage element for restricting the potential on the series connection to a predetermined value.

In a further aspect of the present invention, an insulated gate semiconductor device including a control electrode which is formed on the main surface of the semiconductor substrate in such a manner that an insulated film is interposed therebetween is characterized in that said insulated film is configured to have a partially thick structure.

In a further aspect of the present invention, a vehicle-mounted ignitor comprising a primary coil of an ignition coil and an insulated gate type semiconductor device which are connected in series with a direct current source; an ignition plug connected to a secondary coil of the ignition coil, to which a higher voltage generated across the secondary coil by switching of said semiconductor device is applied; a current restricting circuit for restricting a main current flowing through said semiconductor device to a predetermined value or less by controlling the potential on a control electrode of said semiconductor device; and a current supply circuit for supplying said control electrode with a current from one of a pair of main terminals of said semiconductor device having a higher potential, is characterized in that said current supply circuit is configured to connect said one of said main terminals having a higher potential to said control electrode via not switching element, but a resistor, said system further including an ignition coil unit comprising said semiconductor element, said current restricting circuit and said current supply circuit which are incorporated as a chip; a connecting terminal of said ignition plug which is provided at one end of the ignition coil unit; and an ignition plug which is connected to said connecting terminal, said ignition coil unit and ignition plug being integrated with each other and being embedded in the engine wall so that said ignition plug is exposed within a combustion chamber.

DESCRIPTION OF THE EMBODIMENTS

Figure 1:
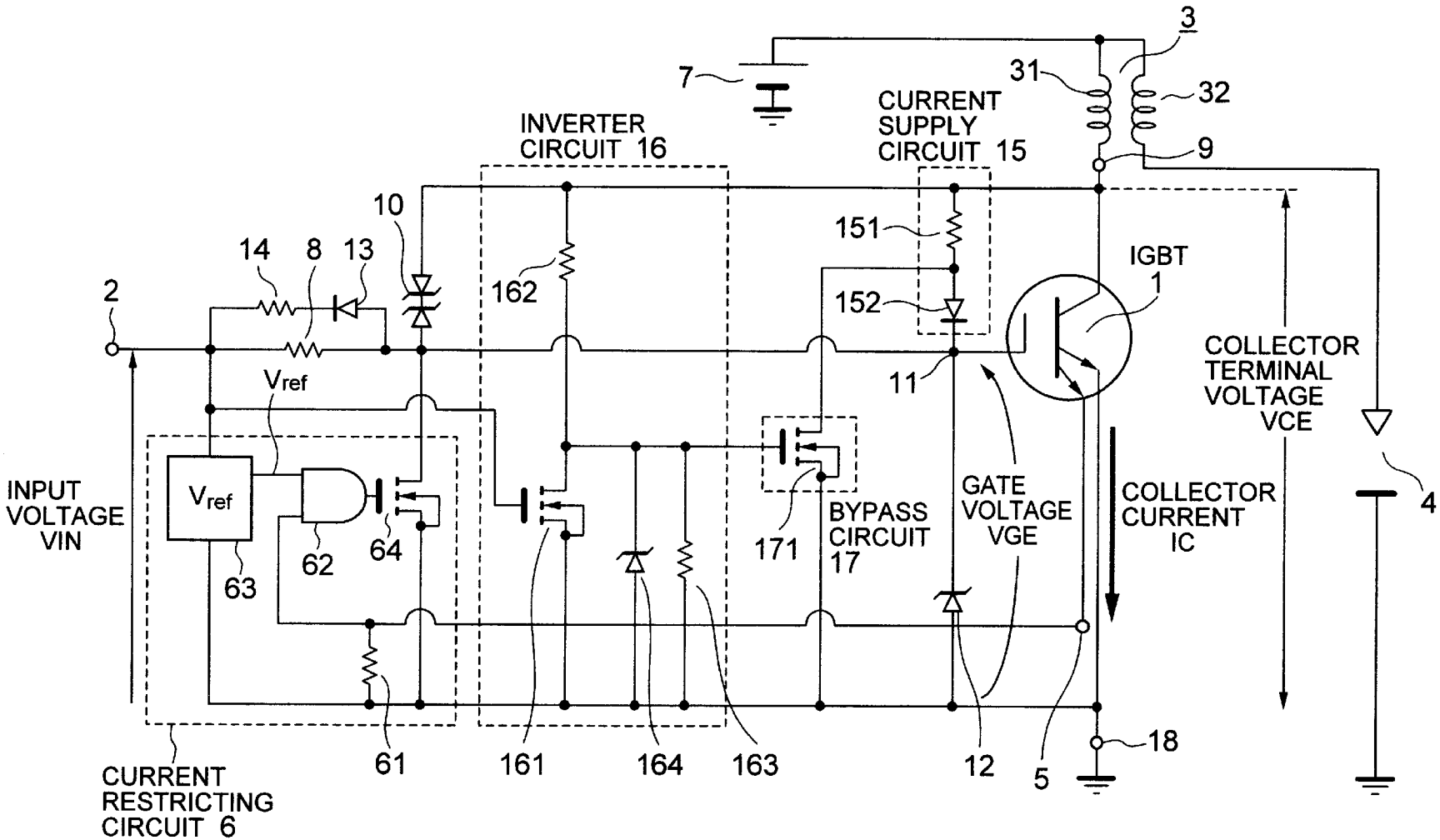
FIG. 1 is an electrical circuit diagram showing a vehicle-mounted ignitor of one embodiment of the present invention.

Referring now to FIG. 1, there is shown a block diagram of a first embodiment of a vehicle-mounted ignitor of the present invention. A reference numeral 1 denotes an insulated gate type semiconductor device, which is herein a main IGBT having current detecting terminals. When an input voltage VIN which is applied to an input terminal 2 is switched to a low level Lo from a high level Hi, the main IGBT 1 is turned off to generate a high voltage on the secondary coil of an ignition coil 2 via its primary coil thereof so that an ignition plug 4 is discharged to fire the fuel.

It is preferable to provide a so-called DIS (distributorless ignition system )in which the circuit of FIG. 1 is provided for each of the cylinders of the engine. In the engine, having, for example four cylinders, four ignition plugs, four ignition coils and four pairs of main semiconductor device and its drive circuit are provided.

The main IGBT 1 comprises a current detecting terminal 5 which is preset to cause a very small detecting current which is about 1/100 through 1/10000 of the collector current Ic to flow therethrough. A detecting resistor 61 in the current restricting circuit 6 is connected to the current detecting terminals 5. The detecting resistor 61 is connected at one of its terminals to a comparator 62 so that the detected voltage on the terminal of the resistor 61 is compared with a reference voltage Vref which is generated by a reference voltage generating circuit 63. When the detected voltage is higher than the reference voltage Vref, the comparator 62 outputs a signal to turn on a gate voltage restricting MOSFET 64 for lowering the gate voltage of the main IGBT 1. The current restricting circuit 6 including the detecting resistor 61, comparator 62, reference voltage generating circuit 63 and the MOSFET 64 serves to restrict the main current of the main IGBT 1 not higher than a predetermined value.

Figure 2:
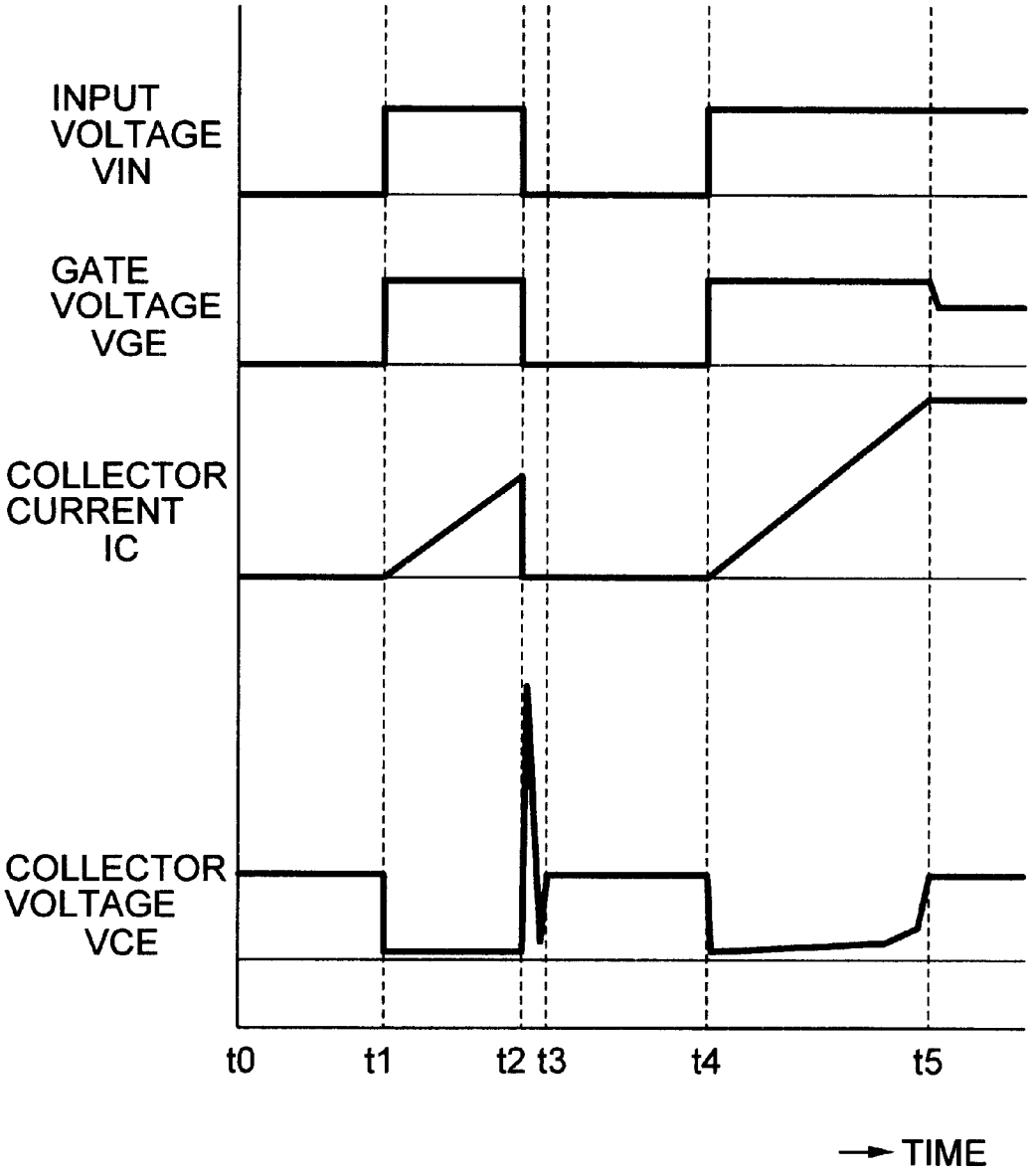
FIG. 2 is a waveform view explaining the operation of the ignitor in FIG. 1.

Now basic operation of the present circuit will be described with reference to the wave form diagram of FIG. 2. In FIG. 2, during a period of time t0 to t1 while the main IGBT 1 is turned off, that is, the collector current Ic does not flow, the voltage on the detecting terminal 5 is 0 volt, the output of the comparator 62 is at the low level Lo so that the MOSFET 64 is turned off. Subsequently, when the input signal VIN of about several voltages is applied to the input terminal 2 at time t1, the gate voltage VGE of the main IGBT 1 increases to turn on the main IGBT 1 so that a collector current Ic flows through the primary coil 31 of the ignition coil 3 from a battery 7 and then flows through the main IGBT 1. Since the load of this circuit is inductance, the collector current Ic monotonously increases with lapse of time.

Subsequently, when the input signal voltage VIN becomes 0 volt at time t2, the collector current Ic decreases and a voltage V1=L×(dIc/dt) is generated across the primary coil of 31 the ignition coil 3 due to a negative rate of change in current, represented by dIc/dt. This voltage is elevated to a few tens thousand voltages across the secondary coil 32 of the ignition coil 3 to ignite the ignition plug 4. In such a manner, the engine obtains a prime power by firing the fuel therein. The input signal VIN is controlled by adjusting the duration of the turning on period of time while monitoring the rotational number of the engine so that an optimum current value Ic is obtained. The pulse width is about a few microseconds to a few tens milliseconds.

Now, the function of the current restricting circuit 6 will be described. The turning on period of time is determined depending upon the rotational number of the engine as mentioned above. If the engine should be stopped for some reason, the duration of the input signal VIN would become a longer, to exceed 1 ms. The collector current Ic continues to increase while the input signal VIN is input. Therefore, the current restricting circuit 6 would be necessary which restricts the collector current Ic to a given value.

When the collector current Ic of the main which is turned on at t4 in FIG. 2 exceeds a given current value at time t5, the output of the comparator 62 becomes a higher level Hi to turn on the MOSFET 64. When the MOSFET 64 is turned on, the gate voltage VGE of the main IGBT 1 is lowered to a voltage which is determined by a voltage dividing ratio which is in turn determined by the gate resistor 8 and the impedance of the MOSFET 64, so that the collector current Ic is restricted. Even if an unexpected condition such as engine stall takes place in such a manner, the collector current Ic is restricted to prevent troubles such as failures of coil and circuit from occurring.

In the present embodiment, there is provided a collector voltage restricting Zener diode 10 for protecting the circuit when an excessive voltage is applied to the collector terminal 9. If the firing of the fuel is failed due to some cause during the operation of the engine, a phenomenon may occur in which the voltage across the primary coil 31 of the ignition coil 3 becomes remarkably higher than a predetermined voltage. At this time, IGBT 1 may be broken if the voltage on the collector terminal 9 exceeds the withstand voltage of the IGBT 1. Accordingly, the IGBT 1 is protected by providing the collector voltage restricting Zener diode 10 to preset its breakdown voltage lower than the withstand voltage of IGBT 1. In other words, when an excessive voltage is applied to the collector terminal 9, breakdown of the Zener diode occurs so that the voltage of the gate terminal 11 increases and IGBT 1 is turned on again to suppress an increase in the collector terminal voltage.

The present embodiment further includes a Zener diode 12 for protecting the gate of the main IGBT 1 and a turning off diode 13 which changes the gate resistance between the turning on and off of the main IGBT 1 for adjusting the speed of turning on and off and a gate resistor 14. The gate resistor 8 has a relatively higher resistance, such as about 1 to 10 kΩ for adjusting the restricted current value and a series circuit of a diode 13 and a resistor 14 is inserted in a reverse parallel relationship with the gate resistor 8 to achieve speeding up when the IGBT 1 is turned on. For this reason, the gate resistor 14 has a resistance which is lower than that of the resistor 8, for example, about 50Ω to 1 kΩ.

Figure 3:
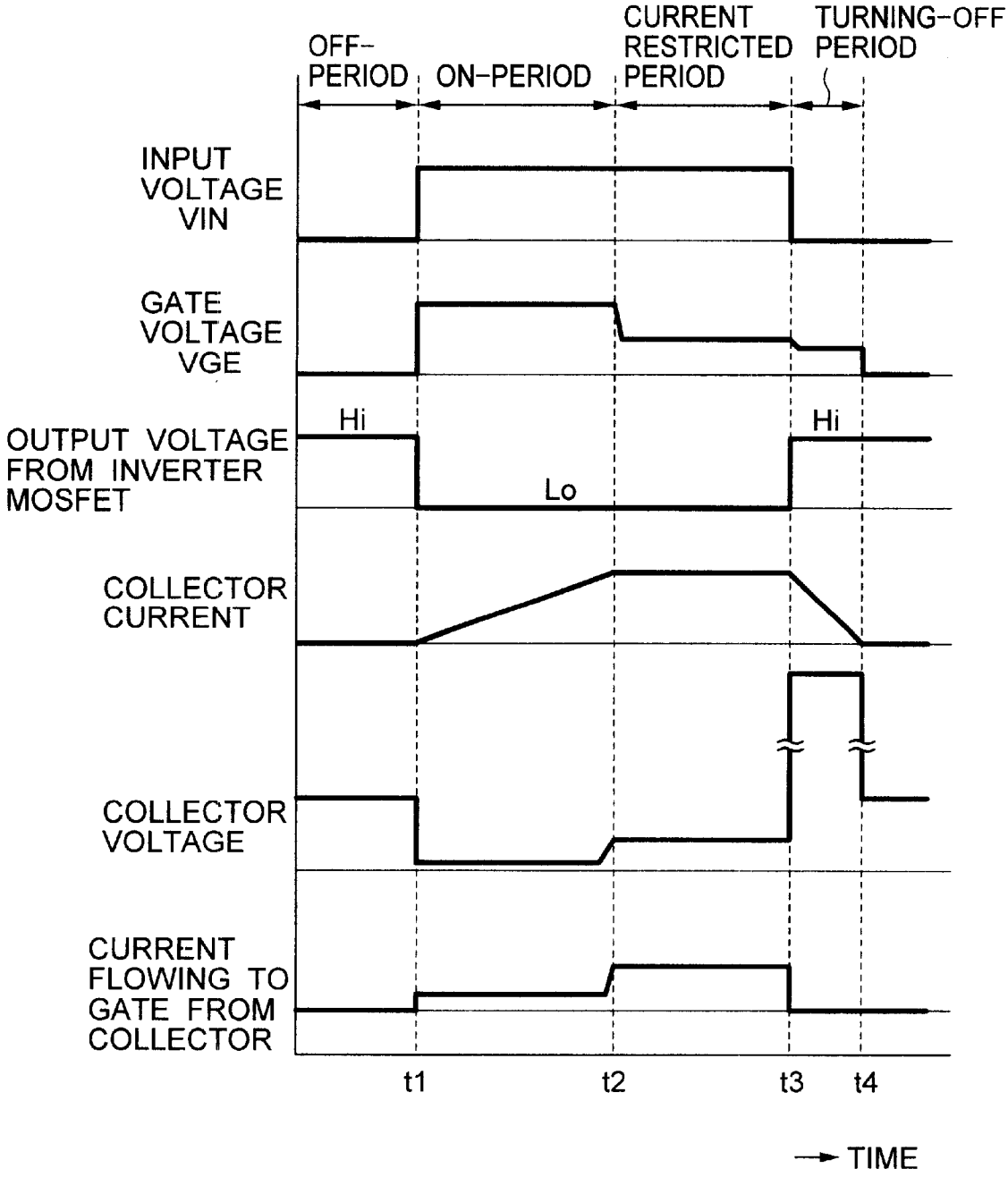
FIG. 3 is a waveform view explaining the operation of the present invention in FIG. 1.

Oscillation may occur when the current restricting function begins to perform as is disclosed in FIG. 3 of the above-mentioned JP-A-09-280147. In the present embodiment, a current supply circuit 15 is provided for suppressing the oscillation. The gate is supplied with an oscillation suppressing current from the collector during the period of time when the main IGBT 1 is turned on, while the output of the current supply circuit 15 is bypassed to the emitter during the period of time when the main IGBT 1 is turned off.

The current supply circuit 15 comprises a series circuit of an oscillation suppressing current supply resistor 151 and a diode 152 which prevents reverse current flowing between the gate and the collector. An inverter circuit 16 comprises a MOSFET 161 which functions in response to an input signal, a collector voltage dividing resistor 162 which is connected to the collector terminal of the MOSFET 161, an output resistor 163 and a protecting Zener diode 164. A bypass circuit 17 comprises a bypassing MOSFET 171 which functions in response to the output of the inverter circuit 16.

Oscillation suppression operation will be described with reference to the waveforms in FIG. 3. Firstly, considering that the main IGBT 1 is turned off until the time t1, output voltage VIN is 0 volt, the MOSFET 161 is turned off and the output of the inverter circuit 16 is at the high level Hi. Accordingly, the MOSFET 171 of the bypass circuit 17 is turned on and the connection between an oscillation suppress current supply resistor 151 and a reverse current preventive diode 152 in the current supply circuit 15 is connected to the emitter terminal 18. Since the main IGBT 1 is turned off, the voltage of the battery 7, for example 12 V and 24 V in passenger cars and trucks and busses, respectively is applied to the collector 9.

Since the MOSFET 171 is turned on at this time, the leak current flowing through the oscillation suppressing current supply resistor 151 is all bypassed to the emitter terminal 18 by the bypass MOSFET 171. This will not elevate the gate voltage of the IGBT 1. Accordingly, no malfunction of the IGBT 1 due to the leak current occur. The bypass MOSFET 171 only requires to be able to flow the leak current and only requires the capacity and size which is remarkably less than that of the main IGBT 1. The capacity of the inverter circuit 16 which drives the bypass MOSFET 171 is low. The collector voltage dividing resistor 162 may have high resistance, so that the leak current which flows out is sufficiently low.

Now, the turning-on state of the main IGBT 1 will be described. When an input signal is applied to the input terminal 2 at time 51 in FIG. 3, the main IGBT 1 is turned on so that the collector current begins to flow so that the collector voltage is abruptly lowered to about several voltages. Since the turning-on signal is also input to the inverter circuit 16, the MOSFET 161 is also turned on, so that the output of the inverter circuit 16 becomes a low level Lo. Accordingly, the bypass MOSFET 171 is turned off so that the resistor 151 of the current supply circuit 15 is isolated from the emitter terminal 18. Since the main IGBT 1 has been already turned on at this time, the potential on the collector terminal 9 has been lowered to about several volts.

On the other hand, the input signal VIN is applied to the gate electrode (terminal) 11 of the main IGBT 1. Accordingly, the potential on the gate electrode 11 is higher than that on the collector electrode 9. However, no current flows to the collector terminal 9 from the gate electrode 11 by the action of the reverse current preventive diode 152. This reverse current preventive diode 151 blocks the current from flowing toward the collector terminal 9 from the input terminal 2 for preventing the drive loss of the main IGBT from increasing. The withstand voltage of the reverse current preventive diode 152 suffices to be sufficiently higher than the input voltage and is about 6 to 9 volts.

Subsequently, when the collector current Ic exceeds a predetermined value at time t2 in FIG. 2, the detected voltage becomes higher than the reference voltage Vref so that the comparator 62 outputs a high level signal Hi and the gate voltage restricting MOSFET 64 is turned on. As a result, the potential on the gate electrode 11 of the main IGBT 1 is restricted to a potential which is determined by the ratio of the gate resistor 8 to the impedance of the gate voltage restricting MOSFET 64 which is turned on and the collector voltage VCE will abruptly increase. However, when the potential VCE on the collector terminal 9 increases so that it is higher than that on the gate electrode 11, the gate is supplied with a current from the collector to prevent oscillation from occurring under condition in which the bypass MOSFET 171 is turned off.

Figure 4:
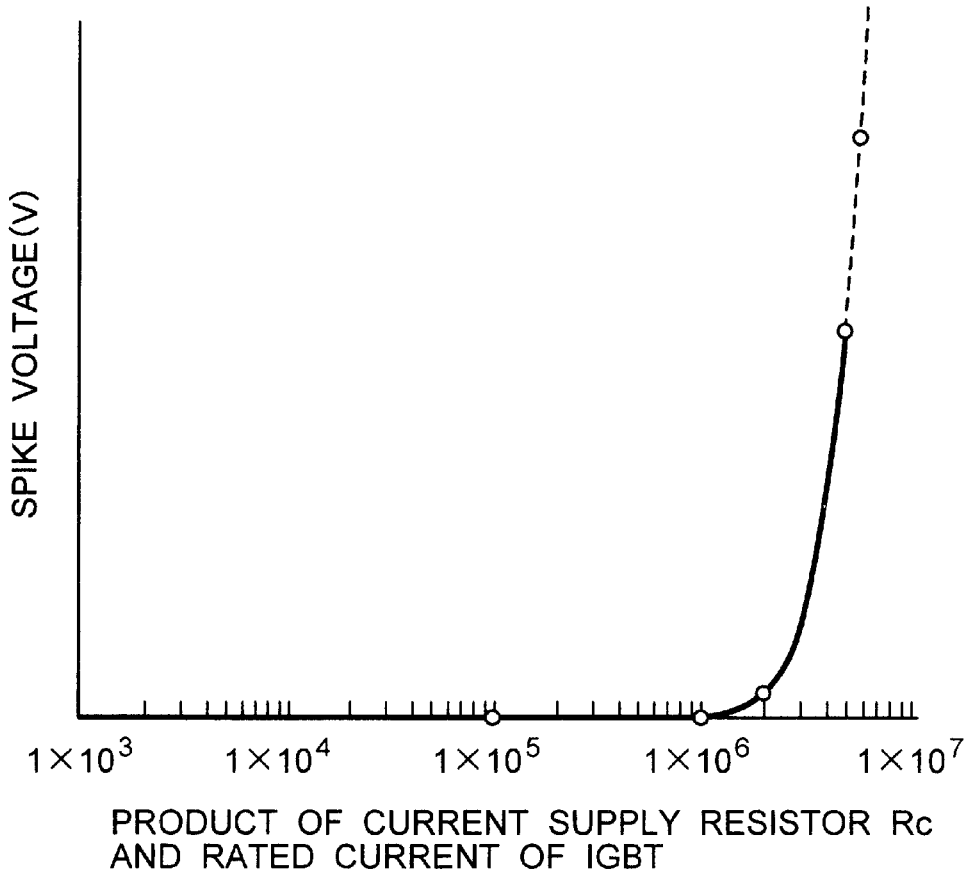
FIG. 4 is a graph showing a circuit condition of a current supply circuit in one embodiment of the present invention.

The lower the resistance of the resistor 151 of the current supply circuit 15 becomes, that is, the higher the current flowing to the gate from the collector becomes, the higher the effect of the oscillation suppression becomes. Since the resistor 151 will cause the leak current when the IGBT is turned off, it is preferable that the resistor 151 has a resistance as high as possible. Experiments show that the resistance Rc preferably falls within the range shown in FIG. 4. Abscissa in FIG. 4 denotes the product of the rated current value of the main IGBT 1 and the resistance value Rc of the current supply resistor 151 while ordinate denotes the spike voltage value (first voltage peak of oscillation) which is generated in the collector voltage at the beginning of the current restriction. The result shows that when the product of the rated current value and the resistance of the current supply resistor becomes larger than $1\times10^6$, the spike voltage will suddenly increase. In case in which the main IGBT has the rated current of, for example, 10 A, the spikes occur when the resistance Rc of the current supply resistor 151 becomes larger than 100 kΩ. Therefore, it is preferable that the product be in the range equal to or less than $1\times10^6$ in abscissa in FIG. 4.

Now, the turning off of the main IGBT1 from the turning on will be described. When the input signal voltage is controlled to 0 V in order to turn off the main IGBT 1 at time of t3 of FIG. 3, the output of the inverter circuit 16 is at the high level Hi since the input thereto also becomes 0 V, so that the bypass MOSFET 171 is turned on. If the potential on the gate electrode 11 is slightly lowered, the collector current Ic begins to decrease. A voltage $V=L\times dIc/dt$ is generated across the primary coil 31 of the ignition coil 3 due to the negative dIc/dt, which is applied to the collector terminal 9. Since the potential on the collector terminal 9 becomes higher than that on the gate electrode 11, a current will flow from the collector. All this leaked current is bypassed to the emitter terminal 18 since the bypass MOSFET 171 is turned on. No leak current flows into the gate. Therefore, malfunction of the IGBT 1 due to the leak current can be prevented.

As mentioned above, in the present invention, the gate is supplied with a current from the current supply circuit 15 when it is necessary to supply the oscillation suppress current from the current supply circuit 15, that is only when the main IGBT 1 is turned on and the current from the current supply circuit 15 is bypassed to the emitter electrode 18 by the bypass circuit 17 when the IGBT 1 is turned off so that the leak current flowing to the gate from the collector will cause a problem. Thus, malfunction of the main IGBT 1 is prevented. In such a manner, in the vehicle-mounted ignitor including the current restricting circuit 6 and the current supply circuit 15 for suppressing oscillation, the output of the current supply circuit 15 is bypassed to the main emitter terminal 18 by the inverter circuit 16 and the bypass circuit 17 when there is no input to be controlled. The ignitor can be formed of only passive elements such as resistors and diodes which can be potentially connected with each other, without requiring any switching elements such as IGBT and MOSFET in the current supply circuit 15. A circuit having less changes in temperature and less production variations can be implemented.

Since the variations in current restriction value can be reduced in the present embodiment, the ignitor can be designed so that its current capacity is low and the circuit can be made compact in size. Reduction in the current capacity enables the ignition coil to be made more compact, which contributes to reduction in size of the engine. Reduction in size of the coil enables mount holes of the engine into which the coils are mounted to be made more compact, resulting in an increase in mechanical strength and durability of the engine.

Figure 5:
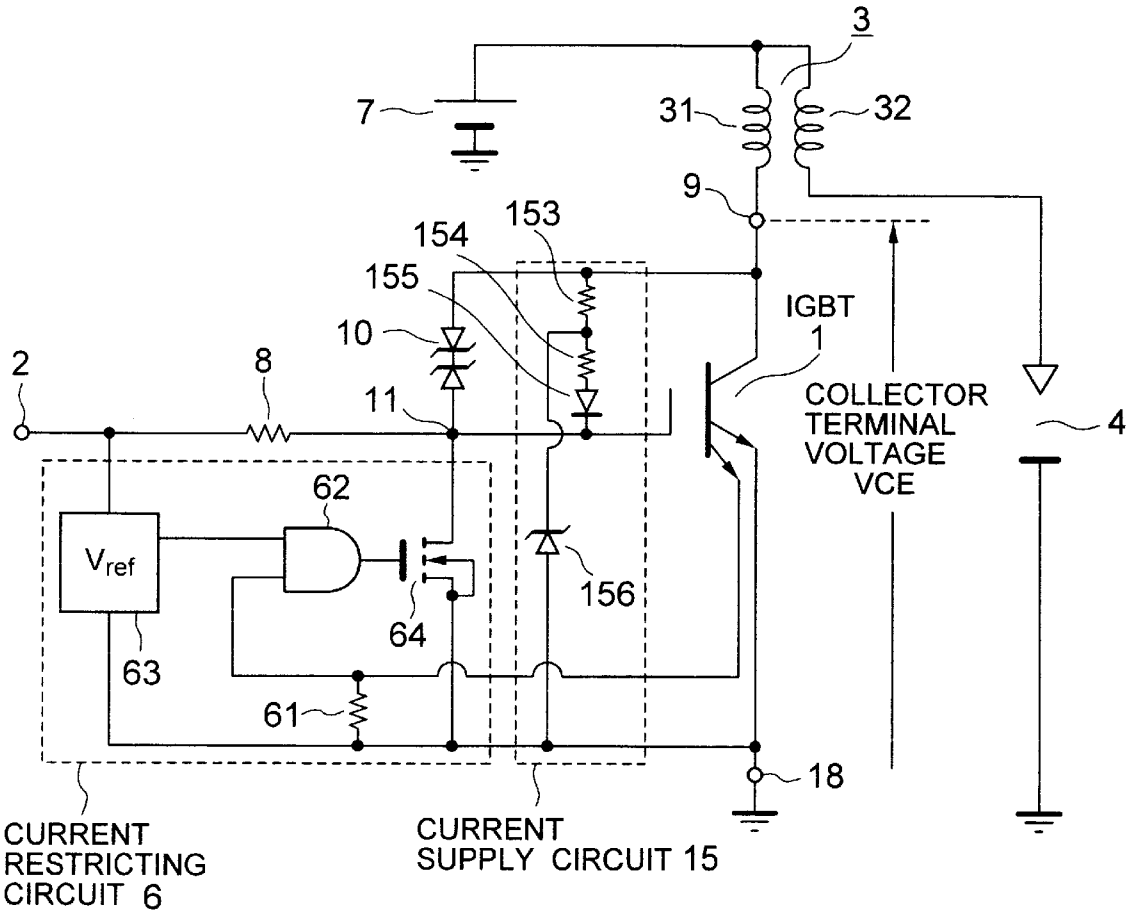
FIG. 5 is an electrical circuit diagram showing a vehicle-mounted ignitor of a second embodiment of the present invention.

FIG. 5 is an electrical circuit diagram showing a vehicle-mounted ignitor of the second embodiment of the present invention. Components which are identical to those in FIG. 1 are represented by identical reference numerals and description thereof will be omitted herein. The present embodiment is substantially identical with that in FIG. 1 except for the structure of the current supply circuit 15. In other words, the second embodiment is different from that in FIG. 1 in that two resistors 153 and 154 and a diode 155 are in series connected. The connection between two resistors is connected to the emitter terminal 18 through a constant voltage element, such as Zener diode 156.

In operation, the voltage of the battery 7, for example 12 volts are applied across the collector and the emitter of the main IGBT 1 when the IGBT is turned off. Since the current restricting MOSFET 64 is turned off at this time, the collector voltage is divided by the oscillation suppress current supply resistor 153, voltage dividing resistor 154 and the gate resistor 8, so that the voltage across the gate resistor 8 is applied to the gate terminal 11 of the main IGBT 1. Since the gate resistor 8 is preset to have a resistance of about a few hundreds Ω to 10 kΩ and the total resistance of the oscillation suppress current supply resistors 153 and 154 is preset to about 10 to 100 kΩ, the gate voltage of the main IGBT 1 may become 5 volts or less depending upon the combination of various resistances. The main IGBT for the ignitor is generally present so that its threshold voltage is about 1 to 3 volts. When the voltage exceeding the threshold voltage is applied to the gate, the main IGBT 2 will be turned on as mentioned above. This problem is overcome by provision of the Zener diode 156 in the present embodiment. Specifically, the gate voltage of the main IGBT 1 can be suppressed to 1/10 of the Zener voltage, that is 0.7 volts to prevent malfunction from occurring by presetting the Zener voltage of the Zener diode 156 to about 6 to 9 volts, for example, 7 volts, and by presetting the voltage which is divided by resistor 154 and the gate resistor 8 so that it will not exceed threshold voltage, for example presetting the gate resistor 8 and the voltage dividing resistor 154 to be 1 kΩ and 9 kΩ, respectively.

Now, the turning-on of the main IGBT 1 will be described. When the main IGBT 1 is turned on, the collector current will increase. If a voltage which is high to turn on the IGBT 1 is applied to the gate, the voltage across the collector and emitter is sufficiently lowered to about 1 to 3 volts. In this state, the Zener diode 156 is not conductive since the potential on the connection between the oscillation suppression current supply resistors 153 and 154 is lowered to 1 to 3 volts or less.

If it is assumed that the main current increases in this state, the current restricting circuit 6 is then activated so that the MOSFET 64 operates for lowering the gate voltage of the main IGBT 1 to keep it to, for example about 3 volts. When the gate voltage begins to lower, the voltage across the collector and emitter begins to increase, so that the above-mentioned initial state of oscillation may occur. However, the oscillation suppress current will flow from the collector terminal 9 toward the gate terminal 11 which is kept at 3 volts, so that the oscillation is suppressed. The collector-emitter voltage at this time is determined by the ratio of the impedances of the primary coil 31 of the ignition coil 3 and the wiring to the impedance of the main IGBT 1. If the impedance of the main IGBT 1 is sufficiently low, the collector-emitter voltage is a low as, for example 2 to 3 volts, o that the current flowing into the gate terminal 11 from the collector terminal 9 will not become so high. In contrast to this, if the impedance of the main IGBT 1 is high or the impedance of the ignition coil or wiring is sufficiently low, the voltage which is applied across the collector and the emitter then becomes, for example 10 volts or more. In this case, the current flowing into the gate terminal 11 from the collector terminal 9 will become remarkably higher than the current which is necessary to suppress the oscillation, so that the gate voltage of the IGBT may exceed the desired current restricted value. Hence, in the present embodiment, a Zener diode 156 is provided and its Zener voltage is preset to, for example, 7 volts. By doing so, the potential on the connection between the resistors 153 and 154 for supplying the oscillation suppress current is fixed to 7 volts even if the voltage at the collector terminal 9 increases. The current which supplied to the gate terminal 11 from the collector terminal 9 is restricted, so that the current exceeding the supplied current will be shunted to the Zener diode 156 for preventing the changes in restricted current value.

Finally, turning-off of the main IGBT 1 will be described. When the input voltage is lowered to 0 volt to turn off the main IGBT 1, the collector-emitter voltage sharply increases, so that a high current is going to flow into the gate of the main IGBT 1 from the collector 9. Malfunction can be prevented by shunting the current flowing from the collector terminal 9, which causes the malfunction due to the fact that the Zener diode 156 is connected to the connection between the series connected resistors 153 and 154 which supplies the oscillation suppress current so that the resistance of each resistor is properly preset. Even if the collector voltage abruptly increases, the potential on the series connected point between the resistors 153 and 154 is kept at the Zener voltage, for example 7 volts. Since this volt of 7 volts is divided at 1/10 by the 9 kΩ of the resistor 154 and 1 kΩ of the resistor 8, the potential on the gate terminal 11 becomes only 0.7 volts. Accordingly, malfunction in which the main IGBT 1 is turned on again can be positively prevented.

If the ratio of resistance of the resistor 153 to that of the resistor 154 in the circuit for supplying the oscillation suppress current is preset to a sufficiently higher value, the current flowing through the Zener diode 156 can be suppressed low, so that a Zener diode having a low current capacity is required.

The present embodiment is capable of restricting the current flowing from a main terminal of the main insulated gate type semiconductor device, having a higher potential (collector of the main IGBT) to its control terminal (gate of the main IGBT).

Specifically, when the voltage of the main terminal having a higher potential (collector of the main IGBT) is lower than a predetermined value, the oscillation suppress current is supplied to said control terminal (gate of the main IGBT) from the main terminal in proportion to the increase in the voltage of the main terminal. When the voltage is higher than a predetermined value, the supply of the oscillation suppress current to the control terminal is restricted to a predetermined value.

In accordance with the present embodiment, the current supply circuit which potentially connects said main terminal with the control terminal may comprise circuit components such as resistors, diodes and a Zener diode, the Zener diode of which can be controlled at a high precision similarly to the first embodiment. Accordingly, the current supply circuits having variations in characteristics due to changes in temperature can be provided.

Figure 6:
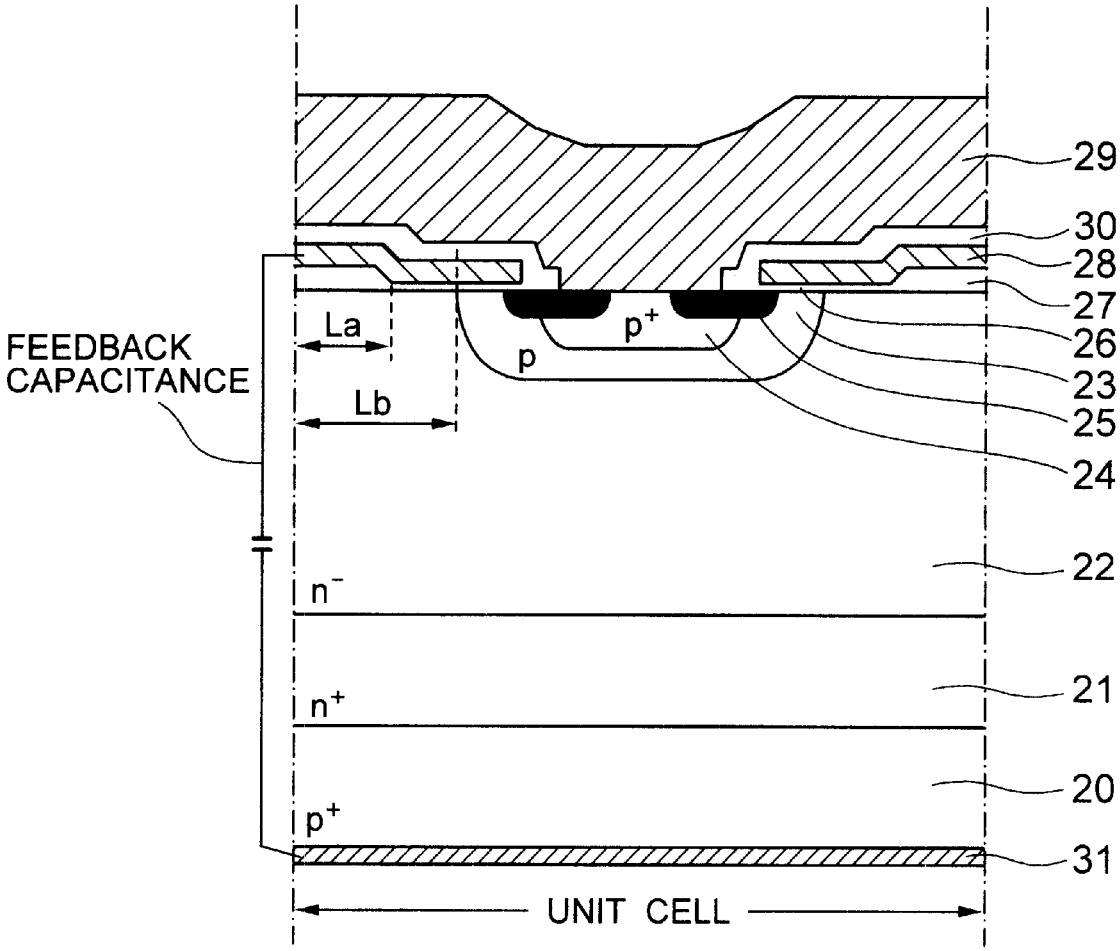
FIG. 6 is a sectional and structural view showing an IGBT in one embodiment of the present invention.

FIG. 6 is a partly sectional view showing an IGBT which is preferably used for the main IGBT 1. The sectional structure of a unit cell is shown in FIG. 6. The IGBT comprises a plurality of unit cells which are arrayed in a parallel relationship.

One chip of the IGBT for ignitor comprises a few hundreds to a few tens thousand unit cells which are arrayed in a parallel relationship. One unit cell of the IGBT has a p-type base layer 23, contact layer 24 and n-type emitter layer 25, which are formed by diffusing dopants into the silicon crystal substrate comprising three layers such as a high dopant concentration p-type collector layer 20, similarly high dopant concentration n-type buffer layer 21 and low dopant concentration n-type drift layer 22. The unit cell further has a gate oxide layer 26 formed on the exposed portion of the base layer 23 in the silicon crystal substrate, terrace gate layer 27 formed on the exposed portion of the drift layer, a polysilicon gate electrode 28 which is formed on the gate oxide layer 26 and the terrace gate layer 27, an emitter electrode 29 which is formed on the upper face of the silicon crystal substrate in contact with the contact layer 24, and an interlayer insulated layer 30 between the emitter electrode 29 and the polycrystal gate electrode 28 for isolation therebetween. A reference numeral 31 denotes a collector electrode.

In the present embodiment, the feedback capacitance is reduced by providing the terrace gate layer 27.

Figure 7:
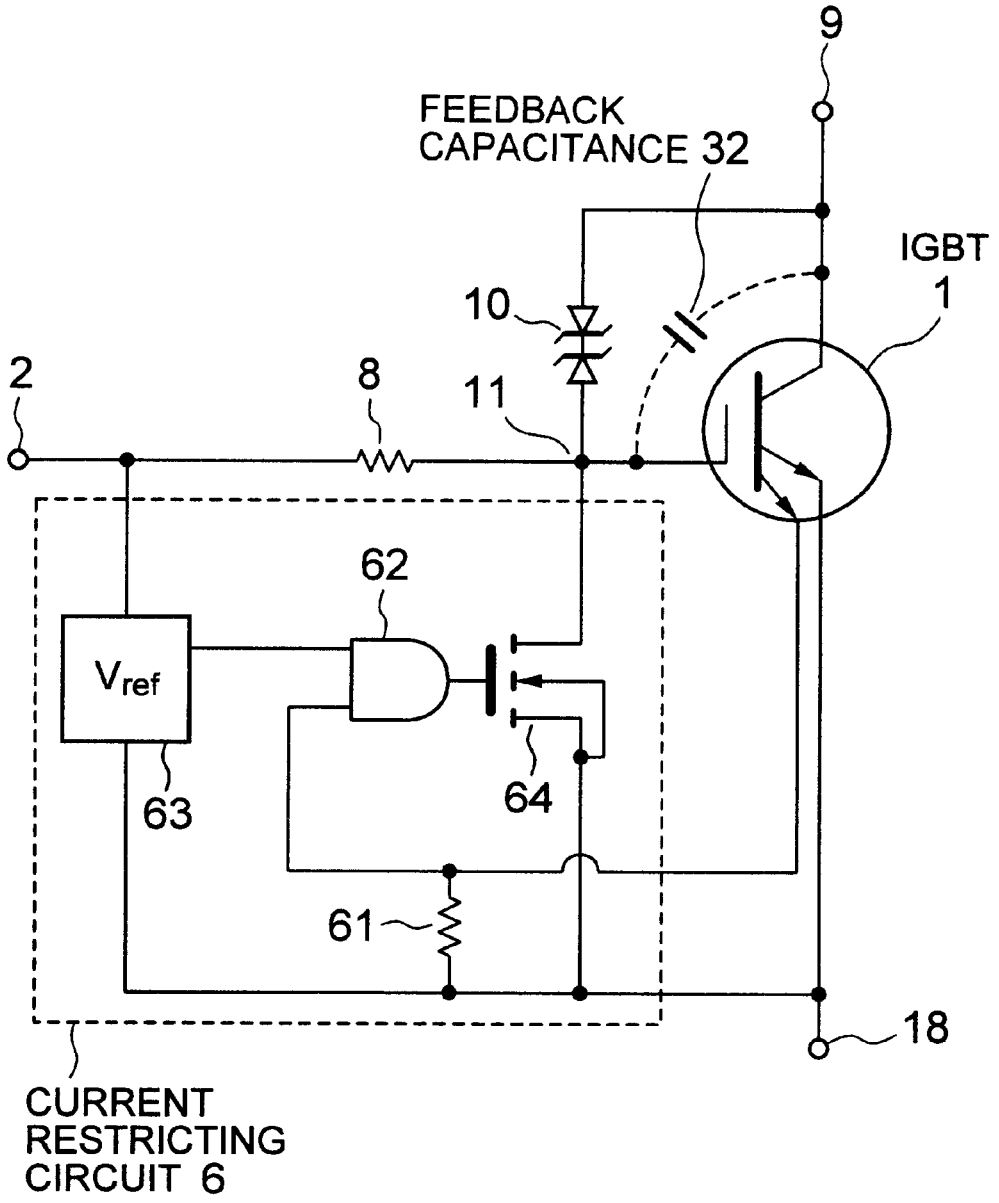
FIG. 7 is an equivalent electrical circuit diagram explaining the feedback capacitance in FIG. 6.

It has been found that one of the causes of the oscillation of the current restriction circuit is the fact that the feedback current flowing from the collector to the gate via the feedback capacitance changes the gate voltage. The feedback capacitance is a parasitic capacitance between the collector and the gate including the capacity of the oxide film between the polycrystal silicon gate electrode 28 and the drift layer 22 and the capacitances of the drift layer, buffer layer 21 and the collector layer 20. FIG. 7 shows its equivalent circuit diagram. The feedback capacitance 32 exists between the collector and the gate as shown in FIG. 7. The other circuit components are designated by like reference numerals of FIGS. 1 and 5. Mechanism of oscillation due to feedback capacity will be described with reference to FIG. 8.

Figure 8:
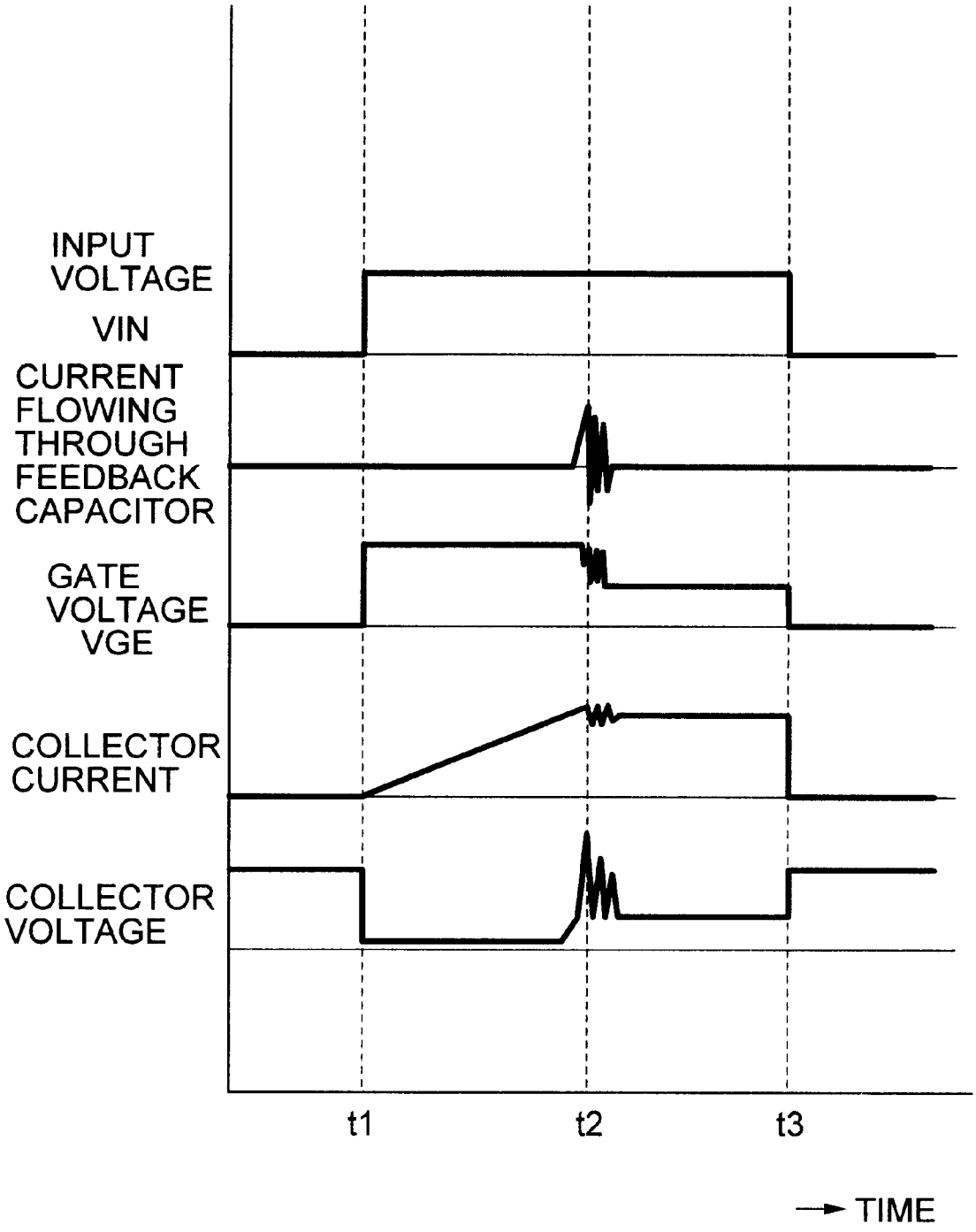
FIG. 8 is a current oscillation waveform view in the electrical circuit of FIG. 7.

FIG. 8 is a waveform diagram of the circuit shown in FIG. 7. When the collector current of the IGBT 1 which was turned on at time t1 exceeds a predetermined value, the current restriction circuit 6 operates to restrict the current to a constant value. When the collector current is suppressed to a constant value by limiting the gate voltage, the collector voltage suddenly increases, so that a current which is represented as i=Cdv/dt (wherein C denotes the capacitance of the feedback capacitor 32) will flow to the collector via the feedback capacitor 32 to the gate. A decrease in gate voltage of the IGBT is suppressed by this current. In association with this, a decrease in the collector current becomes slow. When the collector voltage continues to increase, the capacitance of the feedback capacitor 32 will suddenly decrease.

Figure 9:
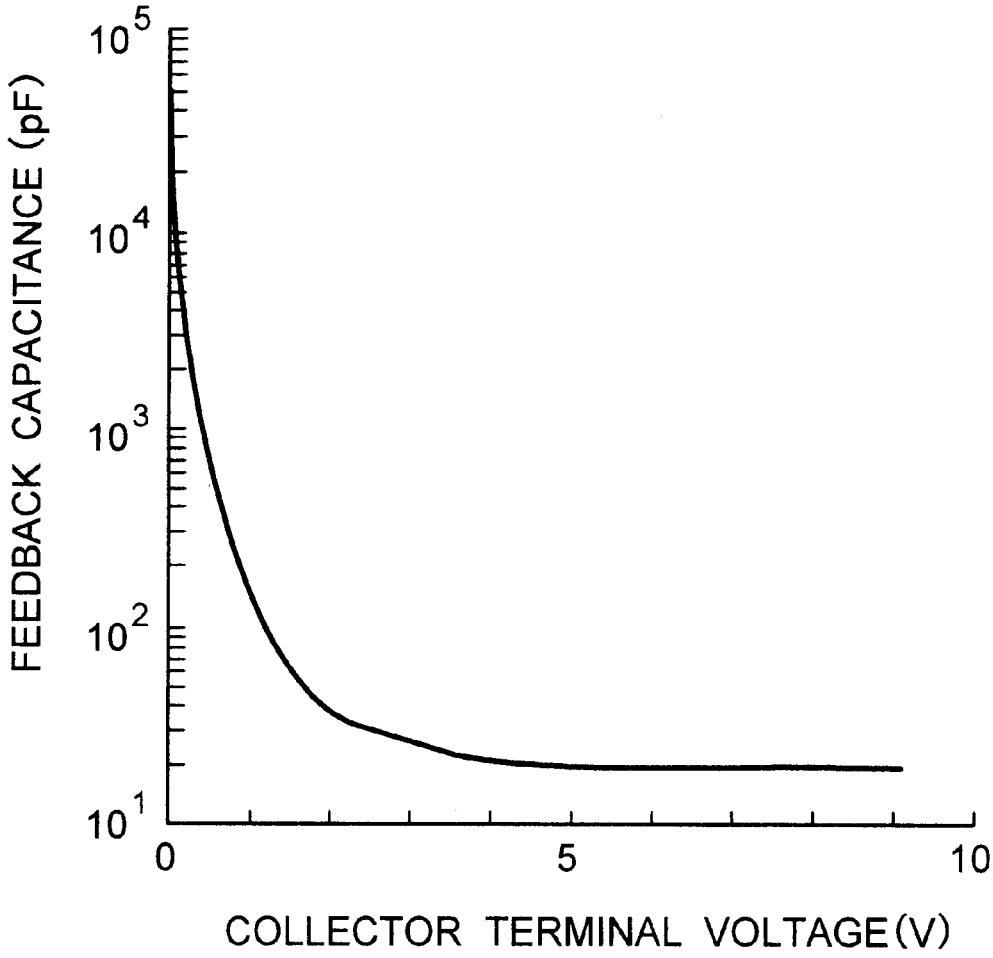
FIG. 9 is a view explaining the dependency of the feedback capacitance upon the voltage in FIG. 6.

FIG. 9 shows the relationship between the feedback capacitance and the collector voltage. Only a slight increase in the collector voltage by about 5 volts will decrease the feedback capacitance from one a few tenth to one a few hundredth. Then, the current flowing into the feedback capacitance 32 suddenly decreases as is apparent from the relationship i=Cdv/dt and the gate voltage is also suddenly lowered. Correspondingly, the collector current also suddenly decreases. Due to the negative rate of change in current at this time, the collector voltage jumps up, causing oscillation and spike voltage generation. The IGBT of FIG. 6 is adapted to decrease the current per se caused by the feedback current to suppress the oscillation and the generation of the spike voltage. At this end, the IGBT is configured in such a manner that the thickness of the gate oxide film 26 which is in contact with the exposed portion of the drift layer 22 to decrease the capacitance. The capacitance C is represented as $C=\in A/D$ wherein $\in$ denotes the dielectric constant, A the area and D the thickness of the gate oxide film. Thickening the gate oxide film enables the capacitance to be decreased.

In a semiconductor device which comprises semiconductor substrates 20 through 22 having a pair of main surfaces; a first layer (base layer) 23 which is formed adjacent to one of the main surfaces in said semiconductor substrate; a second layer (emitter layer) 25 which is selectively formed in said first layer 23; and an electrode (polycrystal silicon gate electrode) 28 which is formed on said main surface so that an insulated film (gate oxide film) 26 is interposed between the electrode 28 and the main surface, the present embodiment is configured in such a manner that said insulated film (gate oxide film) 26 partially has a thick structure (terrace film) 27.

In accordance with the present invention, the feedback capacitance of the IGBT can be decreased to enhance the oscillation suppression by partially providing the insulated film (gate oxide film) 26 with a thick structure 27 (terrace oxide film).

Figure 10:
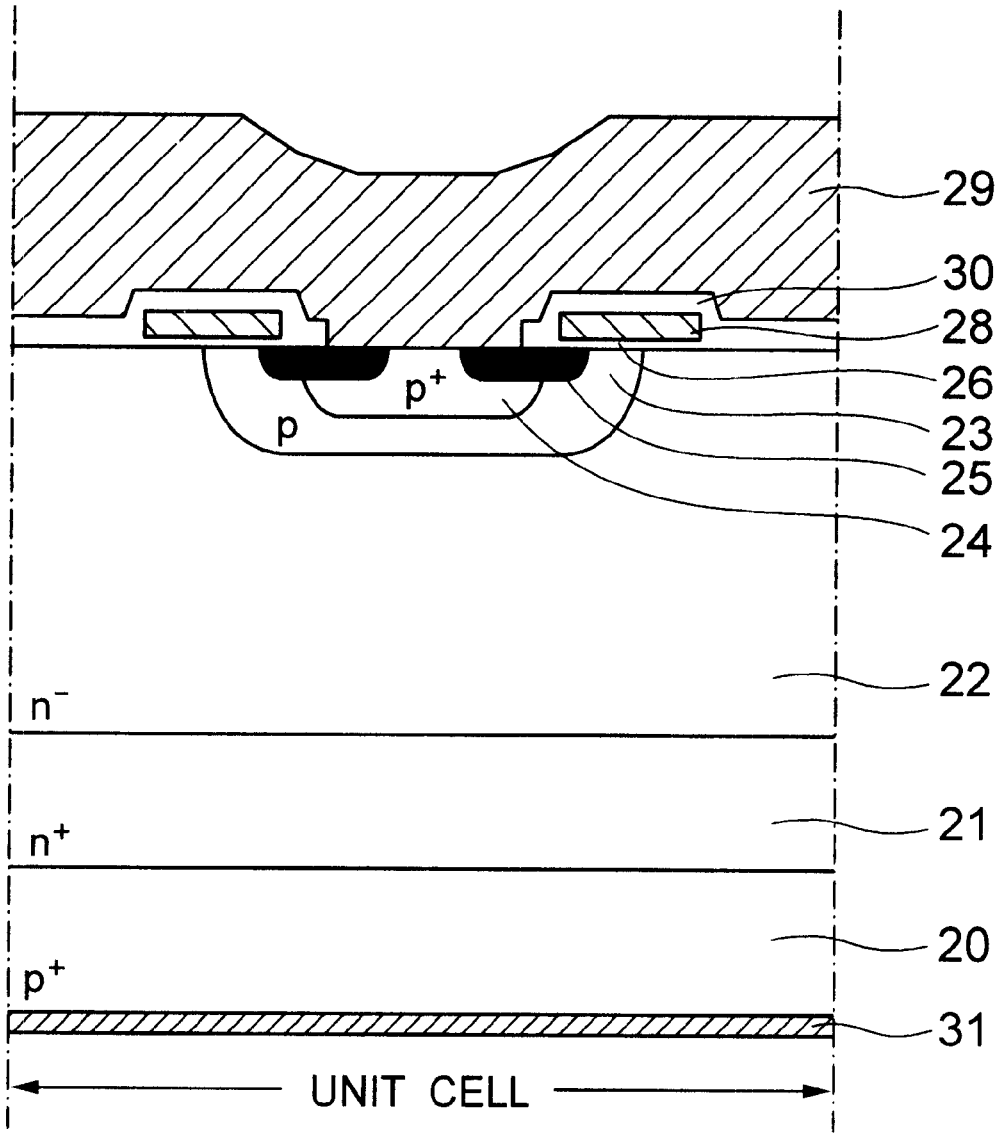
FIG. 10 is a sectional and structural view showing an IGBT of another embodiment of the present invention.

FIG. 10 is a partly sectional structural view showing another embodiment of an IGBT which is preferably used for the main IGBT in said first and second embodiments. In the embodiment of FIG. 6, reduction in capacitance is achieved by increasing the thickness of the oxide film 26 which is part of exposed drift layer 22. Also, configuration in which the peripheral edge of the polycrystal silicon gate electrode 28 is removed on the exposed portion of the drift layer 22 as shown in FIG. 10 is effective to reduce the feedback capacity.

Figure 11:
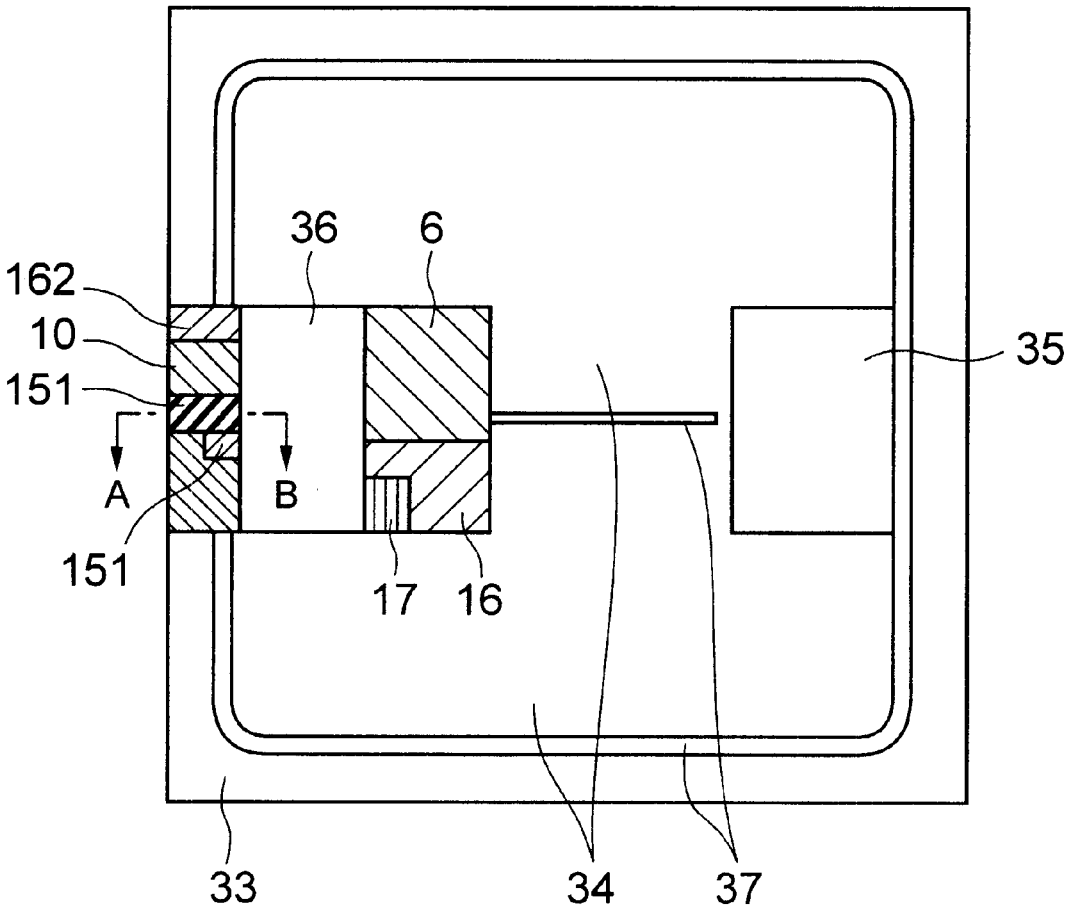
FIG. 11 is a plan view showing a semiconductor chip in one embodiment of the present invention.
Figure 12:
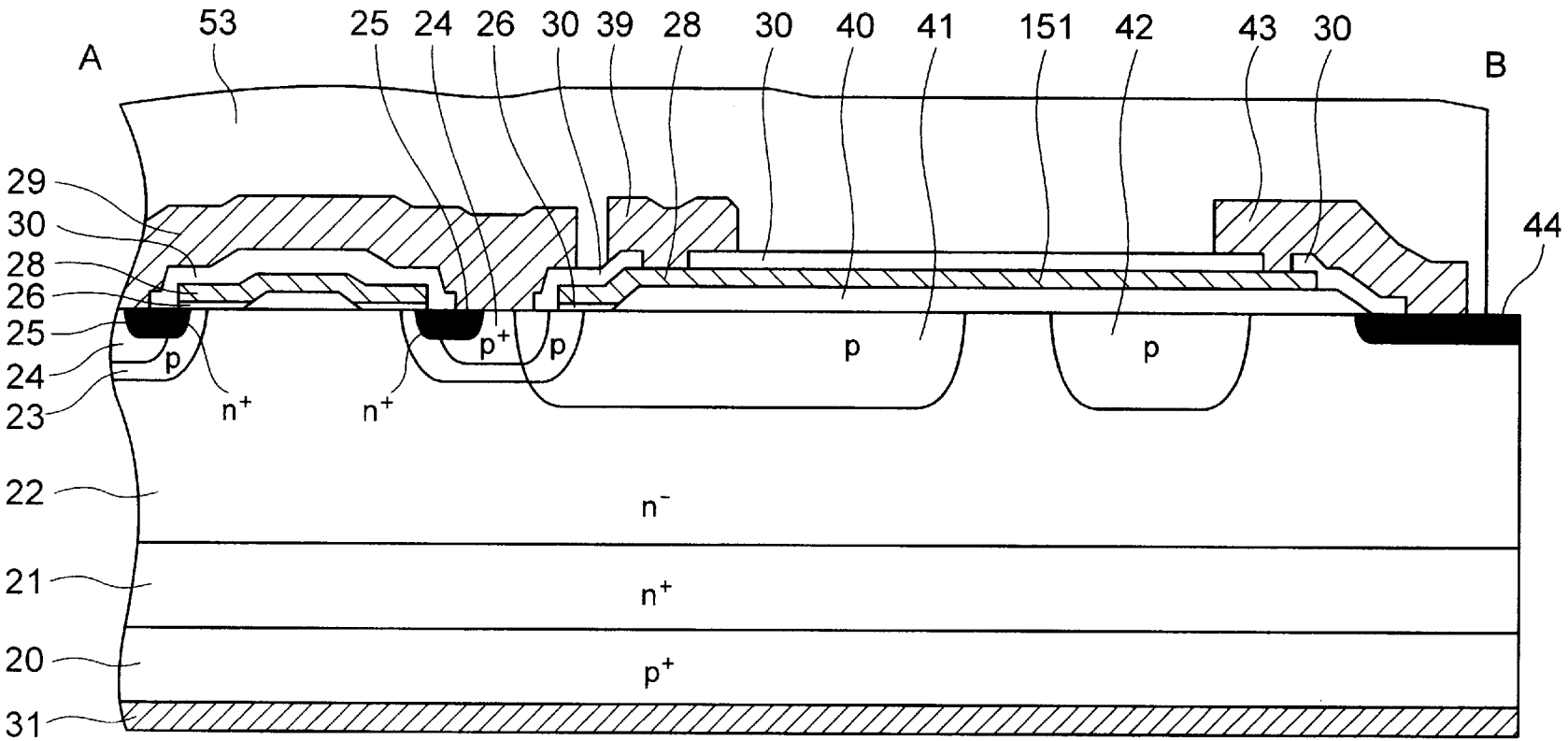
FIG. 12 is a sectional and structural view showing the same semiconductor chip shown in FIG. 11.

FIGS. 11 and 12 are a plan and sectional structural views respectively showing an embodiment of a semiconductor chip of the present invention in which the circuit structure of FIG. 1 is incorporated.

FIG. 11 shows the external structure of an GBT chip in which the circuits of FIG. 1 are integrated. Components which are identical with those in FIG. 1 are designated with identical reference numerals. The IGBT chip includes a peripheral area 33 which is provided on the outer periphery of the chip for keeping the voltage withstand characteristics; an IGBT cell area 34 which is formed inside of the peripheral area 33 and emitter and gate pads 35 and 36, respectively which are provided at corners of the IGBT cell area 34. A drive voltage for the IGBT cell is supplied via a gate wire 37. The current restrict circuit 6 is formed adjacent to the gate pad 36 so that it can quickly respond to the changes in drive voltage. The resistor 151 for supply the oscillation suppression current which constitutes the current supply circuit 15 is formed on the peripheral area 33 to accept the collector terminal voltage and is connected to the reverse current preventive diode 152. The bypass circuit 17 is provided at a corner of the inverter circuit 16 and is connected to the resistor 151 via a wire (not shown).

The present embodiment has a feature that the resistor 151 for supplying the oscillation suppress current is provided on the peripheral area 33. A high voltage is applied to the resistor 151 since the latter is connected at its one of terminals to the collector terminal 9. Accordingly, it is necessary to isolate the resistor 151 from the current restricting circuit 6 and the invertor circuit 16. However, in the present embodiment necessity of special insulation countermeasure is omitted since the resistor 151 is formed on the peripheral area 33. The chip on which these circuits are integrated with each other on one chip can be reduced in size.

FIG. 12 is a sectional view taken along the line A-B in FIG. 11. Components which are identical with those in FIGS. 1 and 6 are represented by identical reference numerals. In the drawing, a reference numeral 38 denotes a protection film which covers the emitter surface of the chip; 39 connection wiring for connecting the resistor 151; 40 a field oxide film; 41 an p-type well layer which is deeply formed to keep the voltage withstand characteristics; 42 an FLR layer which is similarly formed to keep the voltage withstand characteristics; 43 a guard ring for connecting the resistor 151 with the collector; 44 a channel stopper layer and 53 a protective layer.

In the present embodiment, the resistor 151 of the current supply circuit 15 is provided on the peripheral area 33. The resistor 151 is connected at one of its terminals with the collector terminal 9, so that a high voltage is applied thereto. Accordingly, if the device is configured in such a manner that the resistor 151 is adjacent to or incorporated in the area at which the diode 152 in the current restricting circuit 6 and the current supply circuit 25 is formed, then it would be necessary to isolate the resistor from the peripheral elements. In the present embodiment, forming of the resistor 151 on the peripheral area eliminates the necessity of such isolation, which leads to the reduction in chip size in case the current supply circuit 15 is integrated on one chip.

Figure 13:
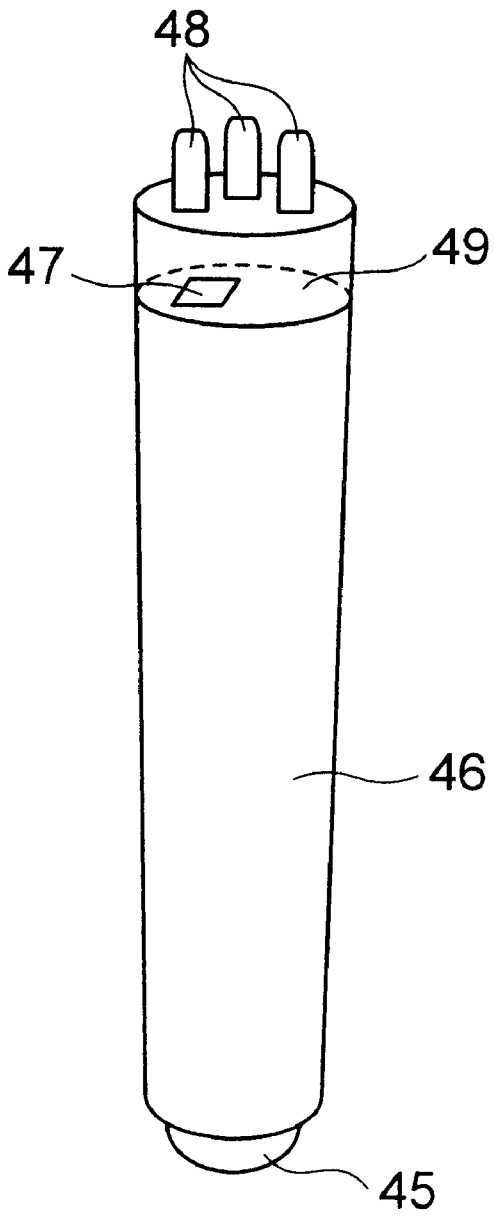
FIG. 13 is a structural view showing an ignition coil unit in one embodiment of the present invention.

FIG. 13 is a perspective view showing the external structure of an embodiment of an ignition coil of the present invention. In FIG. 13, a reference numeral 45 denotes an ignition plug connecting terminal; 46 an ignition coil unit; 47 an IGBT chip; 48 a connection terminal; 4 an ignition coil unit; 47 an IGBT chip; 48 a connection terminal; 49 an IGBT mounted unit. The IGBT mounted unit 49 is represented in the perspective view. The feature of the present embodiment resides in that the current supply circuit 15, current restricting circuit 16, inverter circuit 16 and bypass circuit 17 in FIG. 1 are integrated with the IGBT on one chip, for reducing the size of the coil.

Since the current restricting circuit and the oscillation suppress circuit can be integrated with an IGBT on a chip without increasing the chip area in the present embodiment, the size of the IGBT mounted unit can be reduced and the diameter of the cross section of the IGBT mounted unit 49 can reside within that of the ignition coil unit 46 as shown in FIG. 13. Accordingly, the area at which the ignitor occupies the engine is reduced, resulting in a reduction of the engine size. In the present embodiment, the coils and the IGBT can be disposed in one component, which decreases the number of steps of the assembly.

Figure 14:
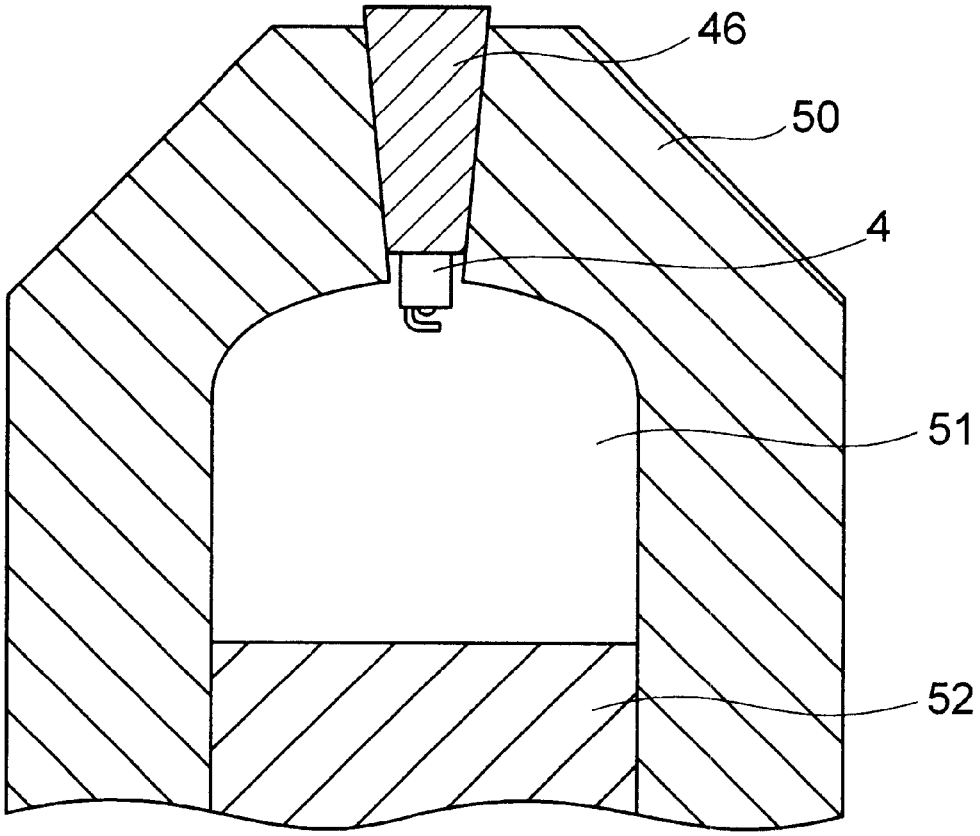
FIG. 14 is a partly sectional and structural view showing an engine system in one embodiment of the present invention.

FIG. 14 is a sectional view showing one engine of the present invention in which the foregoing embodiment is implemented. The ignition coil unit 46 having the ignition plug 4 mounted at its tip end is embedded in a mounting hole of an engine wall 50 so that a part of the plug 4 is exposed in a combustion chamber 51. A reference numeral denotes a piston. The feature of the present embodiment resides in that the hole of the engine wall 50 into which the ignition coil is mounted is reduced in size by mounting the ignition coil unit 36 in FIG. 13 on the engine. Mounting the ignition coil unit 46 on the engine enables the volume by which the coil unit occupies the engine to be decreased, which reduces the engine per se in size. Reduction in size and weight of the vehicle body can be achieved by reduction in size of the engine, resulting in an improvement in fuel consumption. Since the hole of the engine head which is provided for mounting the ignition coil 46 can be reduced in size, which increases the mechanical strength of the engine block and the durability of the engine.

Having described the embodiments of the present invention with reference to the IGBT, the present invention is not limited to the IGBT. Similar advantages can be obtained by using the power MOSFET and the other insulated gate type semiconductor device.

What is claimed is:

1. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less by controlling the potential on a control electrode of said semiconductor device; and a current supply circuit for supplying said control electrode with a current from one of a pair of main terminals of said semiconductor device having a higher potential, wherein said current supply circuit has at least a resistor and potentially connects said main terminal having the higher potential to said control terminal without interposing any semiconductor switching element therebetween.

2. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less; and a current supply circuit for supplying said control electrode with a current from one of a pair of main terminals of said semiconductor device having a higher potential, wherein said current supply circuit connects said main terminal having the higher potential to said control terminal via a series connection of a resistor and a diode.

3. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less by controlling the potential on a control electrode of said semiconductor device; and a current supply circuit for supplying said control electrode with a current from one of a pair of main terminals of said semiconductor device having a higher potential, wherein said ignitor is provided with a bypass circuit which connects said current supply circuit to one of said pair of main terminals, having a lower potential when a signal for driving said semiconductor element is not input to said control terminal.

4. The vehicle-mounted ignitor as defined in claim 3, wherein said bypass circuit comprises a switching element which is connected between the current supply circuit and one of said pair of main terminals having a lower potential and said ignitor is provided with a circuit which turns on the switching element when a signal for driving said semiconductor element is not input to said control terminal.

5. The vehicle-mounted ignitor as defined in claim 3, further comprising an inverter circuit for reversing a signal input to said control terminal and a first switching element which is driven by the output from the inverter circuit.

6. The vehicle-mounted ignitor defined in claim 5, wherein said inverter circuit comprises a second switching element having a pair of electrodes and a drive electrode; and a resistor which is connected between one of said pair of electrodes of said second switching elements and one of said pair of electrodes having a higher potential; said series connection being connected to the control electrode of said first switching element as an output terminal of said inverter circuit.

7. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less by controlling the potential on a control electrode of said semiconductor device; and a current supply circuit for supplying said control electrode with a current from one of a pair of main terminals of said semiconductor device having a higher potential, wherein said current supply circuit comprises a series circuit of at least a resistor and a diode, which is connected in a direction toward said control electrode from said main terminal having a higher potential; and a constant voltage element for restricting the potential on the series connection between said resistor and said diode to a predetermined value.

8. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less; and a current supply circuit for supplying said control electrode with a current from one of a pair of main terminals of said semiconductor device, having a higher potential, wherein said current supply circuit supplies a current to said control terminal from said main terminal having a higher potential for controlling the current to a predetermined value.

9. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less; and a current supply circuit for supplying said control electrode with a current from one of a pair of main terminals of said semiconductor device, having a higher potential, wherein said current supply circuit supplies a current to said control terminal from said main terminal having a higher potential when said voltage of said main terminal having a higher potential is lower than a predetermined value and restricts the supply of the current to said control terminal when the voltage of said main terminal is higher than the predetermined value.

10. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current restricting circuit for restricting a main current flowing through said semiconductor device to a predetermined value or less; and a current supply circuit for supplying said control electrode with a current from one of a pair of main terminals of said semiconductor device having a higher potential, wherein said semiconductor element, said current restricting circuit and said current supply circuit are incorporated within the range of the diameter of the ignition coil unit as a chip.

11. A vehicle-mounted ignitor comprising:

a primary coil of an ignition coil and an insulated gate type semiconductor device which are connected in series with a direct current source;

an ignition plug connected to a secondary coil of the ignition coil, to which a higher voltage generated across the secondary coil by switching of said semiconductor device is applied;

a current flowing through said semiconductor device to a predetermined value or less by controlling the potential on a control electrode of said semiconductor device; and a current supply circuit for supplying said control electrode with a current from one of a pair of main terminals of said semiconductor device having a higher potential, wherein said current supply circuit is configured to connect said one of said main terminals having a higher potential to said control electrode via not switching element, but a resistor, said system further including an ignition coil unit comprising said semiconductor element, said current restricting circuit and said current supply circuit which are incorporated as a chip; a connecting terminal of said ignition plug which is provided at one end of the ignition coil unit; and an ignition plug which is connected to said connecting terminal, said ignition coil unit and ignition plug being integrated with each other and being embedded in the engine wall so that said ignition plug is exposed within a combustion chamber.

* * * * *